United States Patent [19]

Heaton

[11] 4,013,375

[45] Mar. 22, 1977

[54] CURB FORMING MACHINE

[76] Inventor: Blaine Heaton, 411 Keith Ave., Crystal Lake, Ill. 60014

[22] Filed: June 30, 1975

[21] Appl. No.: 591,458

[52] U.S. Cl. ..... 404/98

[51] Int. Cl.[2] ..... E01C 19/52

[58] Field of Search ..... 404/98, 101, 105, 83, 404/84

[56] References Cited

UNITED STATES PATENTS

| | | | |
|---|---|---|---|
| 1,334,483 | 3/1920 | Brooks | 404/98 |
| 2,623,446 | 12/1952 | Clark | 404/98 |
| 2,847,916 | 8/1958 | Andrus | 404/98 |
| 2,864,290 | 12/1958 | Freeman | 404/98 |
| 3,254,578 | 6/1966 | Bessette | 404/98 |
| 3,605,581 | 9/1971 | Heaton | 404/98 |
| 3,749,505 | 7/1973 | Miller | 404/98 |
| 3,779,661 | 12/1973 | Godberson | 404/98 X |
| 3,792,133 | 2/1974 | Goughnour | 404/98 X |
| 3,820,913 | 6/1974 | Miller | 404/98 |

*Primary Examiner*—Nile C. Byers

*Attorney, Agent, or Firm*—Wegner, Stellman, McCord, Wiles & Wood

[57] ABSTRACT

A machine for slip forming curb and gutter having a slip form with an adjustable top wall to vary the height of the curb.

7 Claims, 7 Drawing Figures

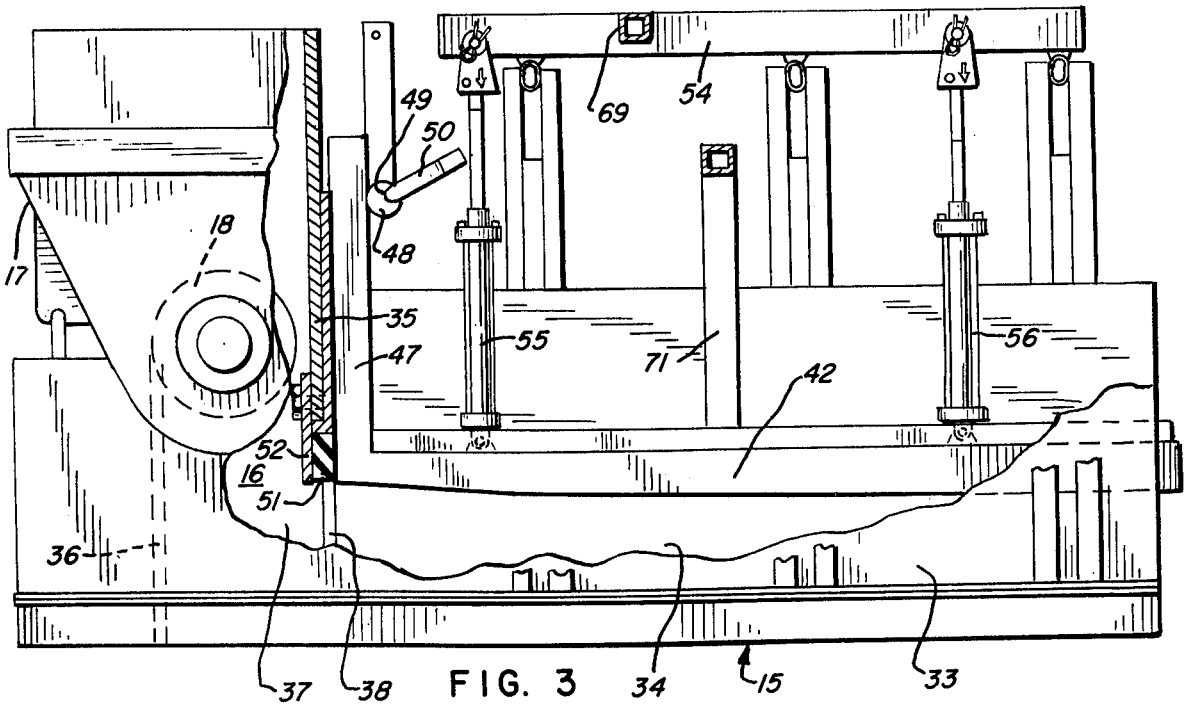
FIG. 3
FIG. 4
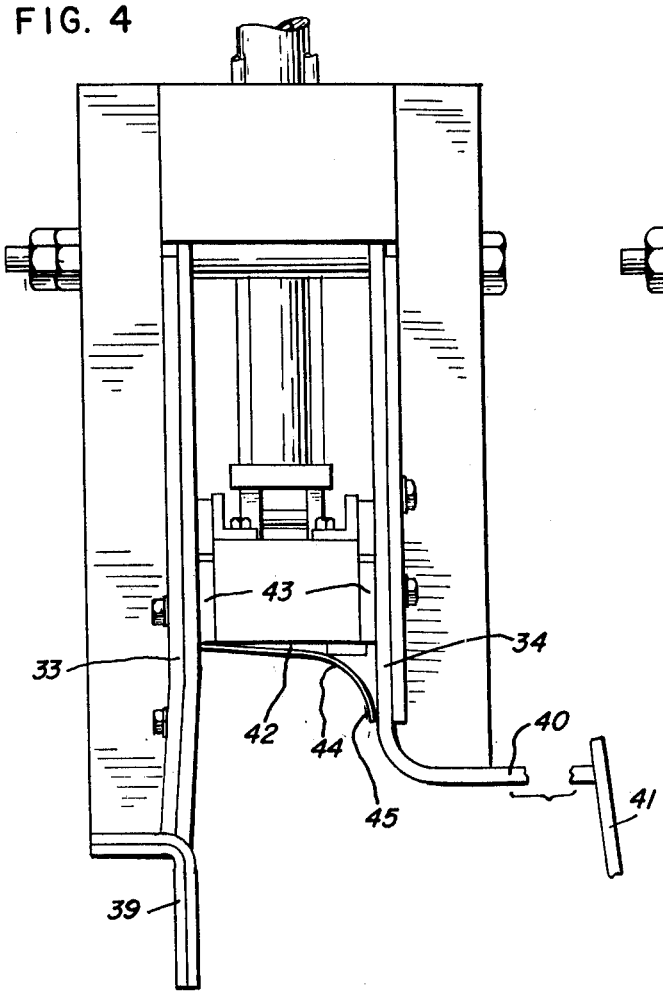
FIG. 5
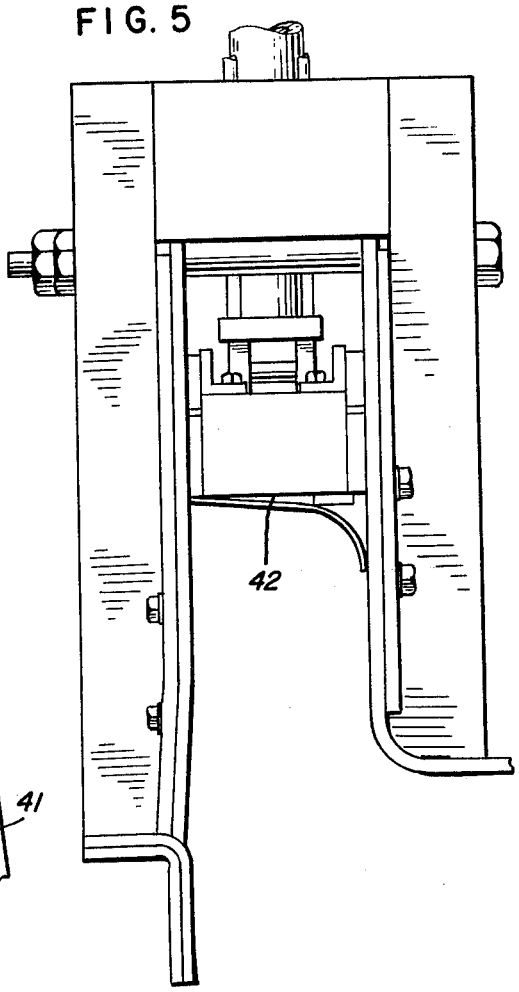

CURB FORMING MACHINE

BACKGROUND

This invention is concerned with a machine for slip forming a concrete curb or curb and gutter and more particularly a curb with a base and a head which follow prescribed grades.

In my earlier U.S. Pat. No. 3,605,581 I show a machine which slip forms a curb and gutter with a fixed dimension between the gutter flag portion and the head or top of the curb. There are road designs in which this vertical curb dimension is not fixed, but varies from point to point along the road. Such curb and gutter cannot be slip formed with the machine shown in my patent.

Consider, for example, the problem of water drainage of a road over flat terrain. It is necessary that the gutter have a longitudinal pitch with a low point at each catch basin and a high point between adjacent catch basins. It is often desired, however, that the head or top of the curb be at a different grade, so as to match an existing sidewalk, for example. Such a design requires that the vertical dimension of the curb change from point to point along the road.

It is a principal feature of my invention that it provides a slip form machine which may be utilized in forming a curb or curb and gutter with a vertical dimension that varies. More specifically, it is a feature of the invention to provide a slip forming machine having moving carrier, a well for feeding concrete to a slip form, side walls for the slip form extending rearwardly from the well, a top wall between the side walls, means for moving the well and side walls vertically with respect to the carrier to establish the grade of the curb, and further means for moving the top wall vertically with respect to the side walls to establish the height of the curb.

Another feature is that the grade and height of the curb are established by a pair of grade lines and the slip forming machine includes a first line sensor mounted to the side walls to control movement of the side walls and a second line sensor mounted to the top wall to control movement of the top wall.

A further feature is that the rear wall of the well has an opening therein through which concrete passes into the slip form, the vertical dimension of the opening corresponding with the maximum height of the slip form top wall, and the top wall has a sealing plate which extends upwardly therefrom adjacent the rear wall of the well and blocks a portion of the opening when the top wall is at a position below its maximum height. More specifically, the sealing plate is held against the rear wall of the well by an adjustably mounted roller.

And another feature is that the top wall of the slip form is moved by a pair of hydraulic cylinders which are actuated to move in synchronism.

Further feature and advantages of the invention will readily be apparent from the following specification and from the drawings, in which:

FIG. 3 is a view similar to FIG. 1 of the slip form with a portion of the outer form wall broken away;

FIG. 4 is an end elevation of the slip form taking from the right of FIG. 3 with the top wall at its lowermost position;

FIG. 5 is a view similar to FIG. 4 with the top wall at its uppermost position;

Figure 1:
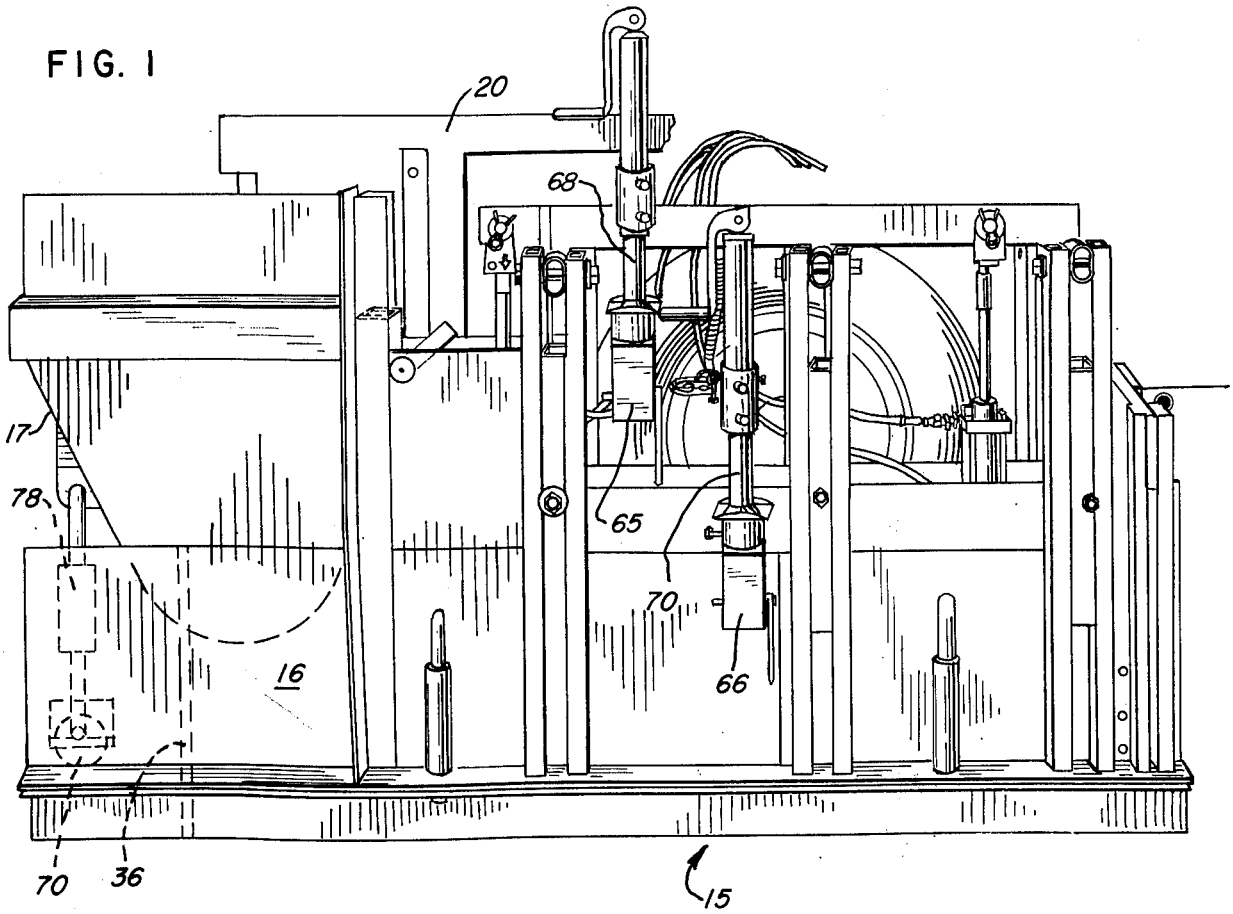
FIG. 1 is a fragmentary elevational view of a portion of a concrete slip forming machine illustrating a slip form incorporating the invention.

Only those portions of the slip forming machine are shown which are required for an understanding of the invention. Details of the slip formed carrier, the machine drive and the concrete feed, for example, are not shown here as they are sufficiently illustrated in my U.S. Pat. No. 3,605,581, the disclosure of which is hereby incorporated by reference.

As best seen in FIGS. 1 and 3–5, a slip form 15 extends rearwardly from a well 16 to which plastic concrete is supplied from a hopper 17 as by a screw 18. The hopper, well and slip form are mounted on the frame 20 of a wheeled carrier shown only fragmentarily in FIG. 1. The bottom of well 16 and of slip form 15 is open so that the concrete is delivered to a suitable subbase prepared on the ground as the carrier moves from right to left, as viewed in FIGS. 1 and 3. The form molds the plastic concrete into a curb or curb and gutter of desired cross-sectional configuration.

Figure 2:
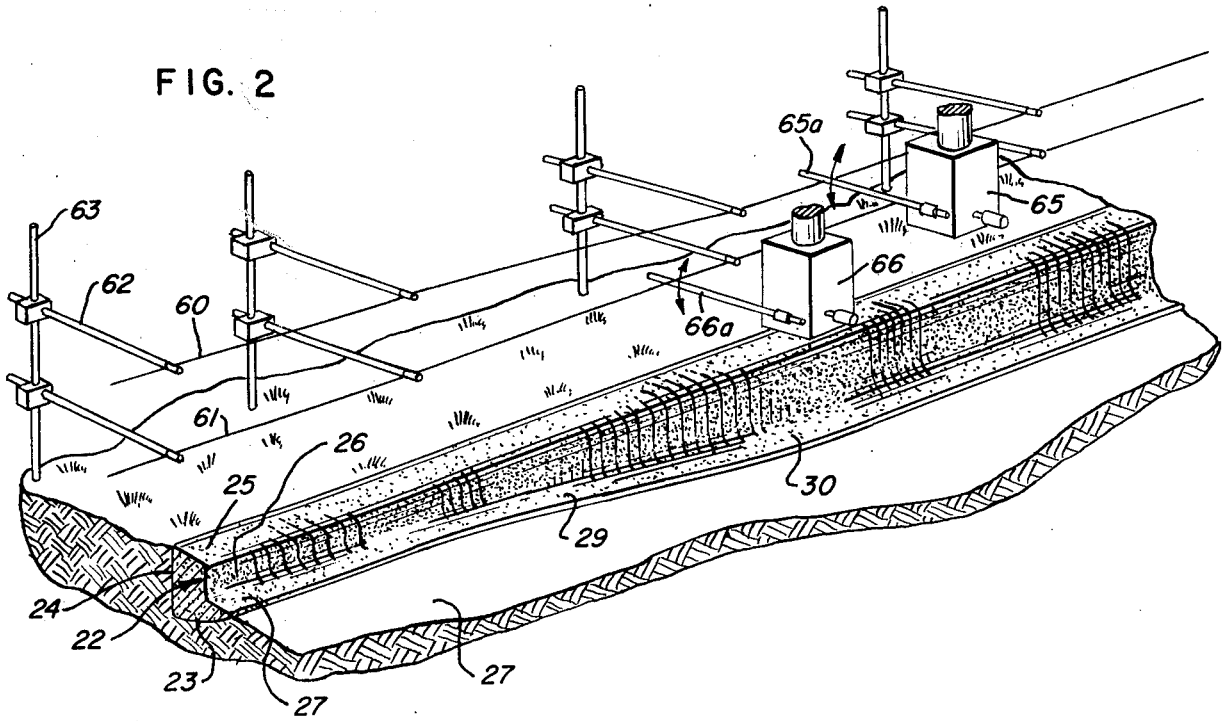
FIG. 2 is a perspective of a section of curb and gutter with appropriate grade lines and line sensors, illustrating the capability of the machine.

A typical section of curb and gutter which may be slip formed in a continuous ribbon by the machine of this invention is illustrated in FIG. 2. The curb 22 has a base 23, an outer lateral surface 24, a head or top 25 and an inner lateral surface 26. A gutter flag 27 extends inwardly to join with the pavement of road 28. The gutter flag 27 is pitched downwardly at a steep slope from a high point at the left side of FIG. 2 to a low point 30 at which a catch basin (not shown) might be located. The gutter flag is pitched up at a moderate slope toward the right in FIG. 2. The ribbon of curb and gutter illustrated in FIG. 2 would be formed by the machine of FIGS. 1 and 3–5 moving from left to right in FIG. 2. The curb head 25 has a constant grade throughout the curb section illustrated, as would be desirable to match a sidewalk, for example.

Details of slip form 15 are best seen in FIGS. 3, 4 and 5. The slip form has outer and inner lateral side walls 33 and 34, respectively. The lateral side walls are secured to and extend rearwardly from rear wall 35 of concrete well 16. The well is closed in front by a wall 36, on the outside by a forwardly extending portion of outer side wall 33 and on the inside by a wall 37. Concrete in the well flows through an opening 38 in rear wall 35 to the space between slip form walls 33, 34. A vibrator (not shown) is preferably positioned in the well to aid in settling the concrete in the form. Outer wall 33 has an angle 39 at the bottom thereof which, in practice, runs close to the subbase on which the curb is formed. The lower edge of inner wall 34 has a flange 40 which extends inwardly and defines the surface of the gutter flag 27. Plate 41 secured to the inner edge of flange 40 defines the inner surface of the gutter.

Top wall 42 of the slip form is mounted for movement up and down between the lateral side walls 33, 34 to vary the vertical dimension of the curb. A low position is illustrated in FIG. 4 and a high position in FIG. 5. The under surface of top wall 42 is tapered from front to rear (left to right as seen in FIG. 3) to reduce the pressure of the plastic concrete on the movable top wall. In one embodiment, top wall 42 is 5 feet long. It has a taper of 1 inch in the first foot and 1 inch in the next four feet. Resilient strips 43 on each side of top wall 42 seal with side walls 33, 34. A curved plate 44 secured to the under surface of top wall 42 has an inner lower edge 45 which blends with inner side wall 34, the curved plate forming a desired contour on the upper inner corner of curb 22. Plate 44 is preferably of stainless steel to minimize wear from the abrasive concrete.

The opening 38 in the rear wall 35 of well 16 has a vertical dimension which corresponds with the maximum elevated position of top wall 42. FIG. 3. A sealing plate 47 extends upwardly from the forward end of top plate 42 adjacent the outer surface of the rear wall 35 of well 16. Plate 47 is held in close engagement with the wall 35, to prevent leakage of the plastic concrete, by a roller 48 mounted on an eccentric shaft 49 which is positioned by a handle 50. A resilient block 51 is held against the lower end of seal plate 47 by a clamp 52.

Side walls 33 and 34 are secured to and move up and down with well 16, hopper 17 and the frame of the machine, shown in detail in my aforementioned patent. The vertical position of the side walls establishes the grade of the flag surface of the gutter and the base of the curb. It is assumed that the subbase is appropriately graded prior to forming of the curb and gutter so that the lower edge of outer side wall 33 is close to the ground and the plastic concrete is not allowed to spill out to the side.

A frame member 54 is secured to the side walls 33 and 34 and extends longitudinally over the center of the slip form. Frame member 54 moves up and down with movement of the side walls relative to the carrier frame. Two hydraulic cylinders 55, 56 extend between top wall 42 and frame member 54 and are secured thereto with suitable pivoted couplings. Actuation of the two hydraulic cylinders causes top plate 42 to move up and down with respect to side walls 33, 34, establishing the vertical dimension of curb.

In forming the curb section illustrated in FIG. 2, moving from left to right of the figure, the lateral side walls move downwardly at a rapid rate to form the steep grade at 29, while the top wall 42 is moved upwardly with respect to the side walls to maintain the head 25 of the curb at a constant grade. As the machine moves past low point 30, the slip formed side walls are moved upwardly and the top wall moves downwardly with respect thereto.

I prefer that automatic controls be provided for the vertical movement of the slip formed side walls and top wall, to simplify the operation of the machine as it moves along the road. In FIG. 2, two guide lines 60 and 61 are provided, each strung on arms 62 adjustably mounted on posts 63 placed at intervals along the road. Line sensors 65 and 66 are mounted on the machine and respond to the line 60, 61, controlling the vertical movement of the side walls and top wall of the slip form, as will appear. The line sensors 65 and 66 have pivoted arms **65*a*, 66*a* respectively which are pivoted and counterbalanced to follow lines 60, 61. Line sensor 65 is suspended from a carried 68 secured to an arm 69 carried by frame member 54 and thus moves up and down with the side walls 33, 34 of the slip form. Line sensor 66 is suspended from a carrier 70 mounted on post 71 which is secured to the top wall 42** of the slip form and moves up and down with it.

The lines 60, 61 in FIG. 2 correspond in grade with the curb base or gutter flag and with the curb head, respectively. The controls for the side walls and top wall of the slip form operate to keep the outputs of the line sensors 65, 66 in a neutral condition. If the pivoted arms **65*a*, 66*a* depart from this neutral condition in following the lines 60, 61,** the walls of the slip form are moved accordingly.

Figure 6:
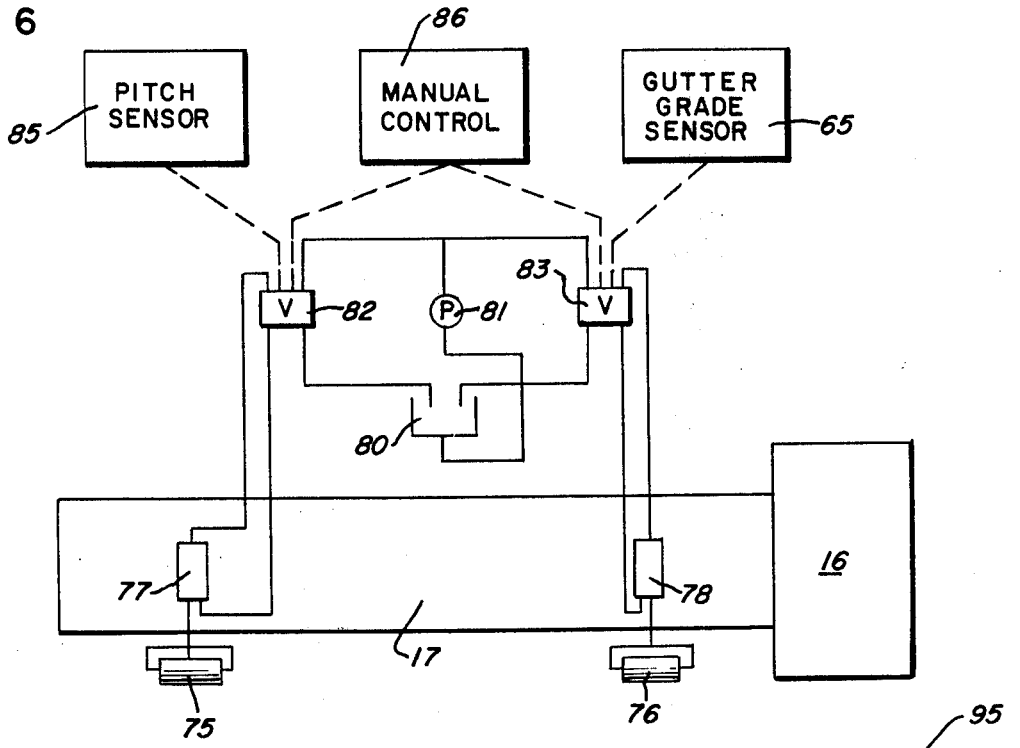
FIG. 6 is a diagrammatic illustration of the control for the elevation and lateral pitch of the slip form.
Figure 7:
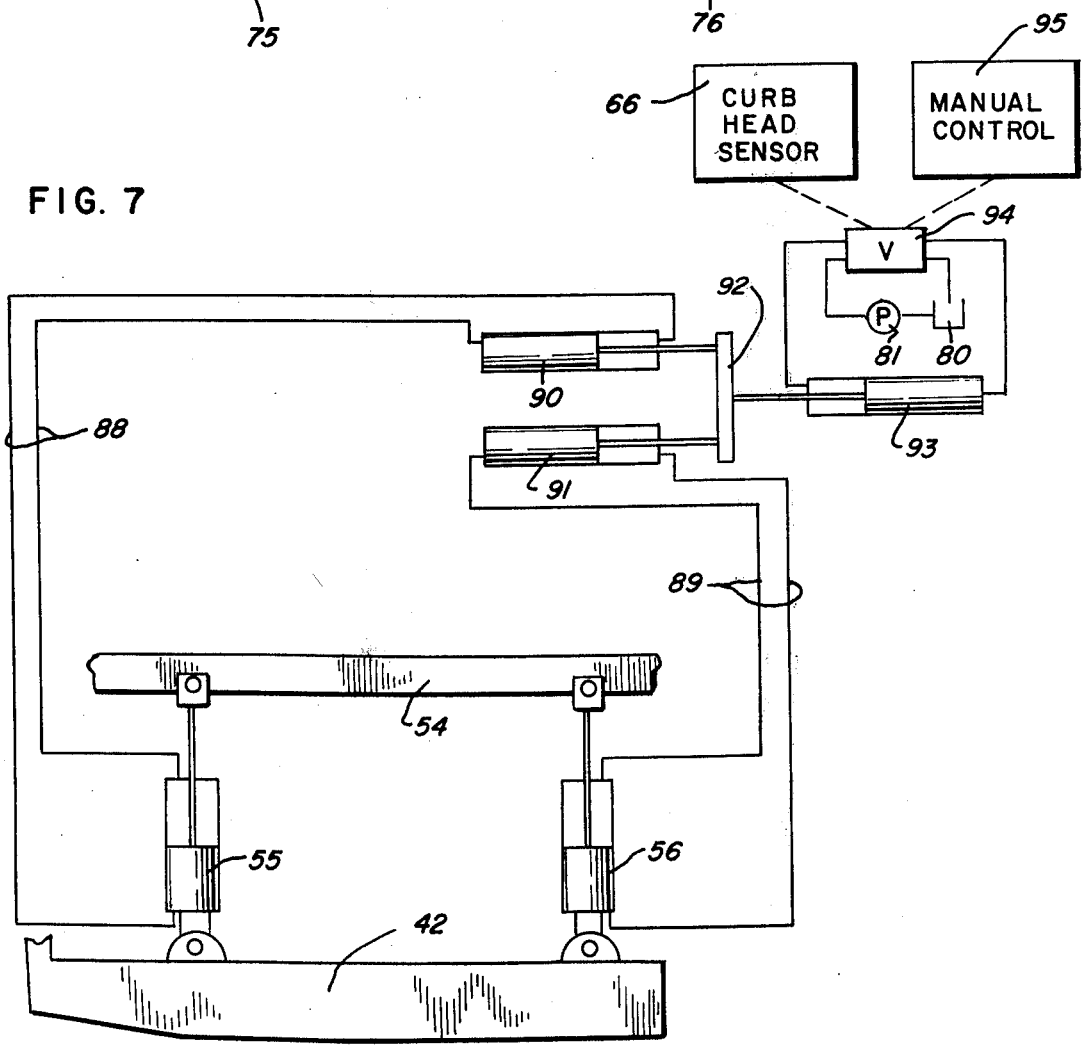
FIG. 7 is a diagrammatic illustration of the control for the top wall of the slip form.

The hydraulic control systems are illustrated in more detail in FIGS. 6 and 7. The apparatus in FIG. 6 is basically that of my patent with an automatic gutter grade and pitch control. The concrete hopper 17 and well 16 are supported by a pair of ground engaging wheels 75, 76 connected at laterally spaced points of the hopper 17 by hydraulic cylinders 77, 78. Cylinder 78 is operated to establish the grade of the gutter (or the base of the curb). Cylinder 77 rotates hopper 17 and well 16 about a pivot point provided by wheel 76, establishing the pitch of the gutter, which is generally constant, except for situations like the outside of a curve illustrated in my patent. The hydraulic system for cylinders 77 and 78 includes a sump 80, pump 81 and valves 82, 83 for the cylinders, 77, 78, respectively. Valve 83 is operated by gutter grade sensor 65 to move well 16 and thus the side walls 33, 34 of the slip form up and down to follow grade line 60. Valve 82 is operated by a pitch sensor 85 mounted on the carrier frame to which hopper 17 is secured, to maintain the desired pitch with changes in grade of well 16 and irregularities of the surface over which wheel 75 travels. A manual control 86 enables the operator to modify the action of the automatic controls.

In FIG. 7 the two hydraulic cylinders 55, 56 which move the slip form top wall 42 with respect to side wall frame member 54 are shown connected in separate hydraulic circuits 88, 89 with hydraulic actuator cylinders 90, 91, respectively. The pistons of the hydraulic actuator cylinders 90, 91 are mechanically coupled through a cross yoke 92 which which is moved by the piston of a master hydraulic actuator 93. The hydraulic system includes a valve 94 operated by curb head sensor 66 to control the hydraulic fluid which positions master actuator 93. Movement of the piston of master actuator 93 causes equal movement of the pistons of hydraulic cylinders 55, 56 so that wall 42 moves evenly up and down regardless of the distribution of pressure exerted against the under surface by the plastic concrete. A manual control 95 is also provided for valve 94.

The automatic controls for the gutter and curb head grade enable the operator to concentrate on driving the machine while the slip form side walls and top walls follow the grade lines 60, 61. A curb, or curb and gutter of a complex configuration can readily be installed without the expense of manually setting forms and pouring the concrete.

I claim:

1. A form movably carried for slip forming plastic concrete delivered from a well having a rear wall with an opening therein into a curb having a varying dimension between the base and head of the curb, comprising:

a pair of generally vertical side walls spaced laterally apart with respect to the direction of movement of the form and defining the vertical surfaces of the curb, the leading edges of said side walls being joined to the rear wall of said well, one on either side of said opening, the lower edge of one of said walls establishing the grade of the base of the curb;

a generally horizontal top wall extending between said vertical walls, defining the head of the curb, said top wall being movable vertically with respect to the side walls to vary the vertical dimension of the curb; and means for sealing said top wall to the rear wall of the well above said opening.

2. The slip form of claim 1 in which the under surface of the top wall has a longitudinal downward taper from the leading end to the trailing end thereof.

3. The slip form of claim 1 in which said top wall has a sealing plate extending upwardly at the leading end thereof, adjacent the rear wall of the well, and means for holding the sealing plate against the rear wall of the well.

4. The slip form of claim 3 having a roller mounted on an eccentric cam bearing against said sealing plate to hold it in sealing engagement with the rear wall of the well.

5. The slip form of claim 3 including a resilient sealing surface between the sealing plate and the wall of the well.

6. The slip form of claim 7 including:

a frame member secured to said side walls, extending longitudinally of the slip form and spaced above the top wall;

a pair of hydraulic cylinders connected between the frame member and the top wall and spaced longitudinally of the top wall;

a pair of hydraulic actuator cylinders, one connected with each of said hydraulic cylinders to deliver hydraulic fluid thereto, said actuator cylinders each having a piston;

means connecting said actuator cylinder pistons together to move in unison; and a master actuator for moving the pistons of the actuator cylinders to deliver hydraulic fluid to the hydraulic cylinders to move the top wall of the slip form up and down.

7. In a machine for slip forming a concrete curb on the ground, including a movable carrier for travel across the ground, and a well on the carrier for delivering plastic concrete to a slip form in the rear of the well, the well having a rear wall at the front of the slip form, the improvement comprising:

slip form side walls spaced apart laterally with respect to the direction of carrier movement, said side walls defining the lateral surfaces of the curb and the lower edge of a side wall establishing the grade of the base of the curb, said side walls being open at the bottom to deposit concrete onto the ground;

a slip form top wall between the lateral walls defining the head of the curb;

means connected with the slip form top wall for moving the slip form top wall vertically between and with respect to the side walls to vary the vertical dimension of the formed curb and establish the grade of the head of the curb, the rear wall of said well having an opening into the slip form with a vertical dimension corresponding with the maximum height of the slip form top wall with respect to the side walls; and a sealing plate extending upwardly from said slip form top wall adjacent the rear wall of the well to block a portion of said opening when the top wall is at a position below its maximum height.

* * * * *